US010413015B2

(12) United States Patent
Schoenborn et al.

(10) Patent No.: US 10,413,015 B2
(45) Date of Patent: Sep. 17, 2019

(54) CUSHIONING SYSTEM FOR FOOTWEAR

(71) Applicant: Wolverine Outdoors, Inc., Rockford, MI (US)

(72) Inventors: Mary L. Schoenborn, Rockford, MI (US); Chris J. Loveder, Rockford, MI (US); Jie Xu, Dongguan (CN); Amanda Marie Hargraves, Grand Rapids, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 210 days.

(21) Appl. No.: 15/796,349

(22) Filed: Oct. 27, 2017

(65) Prior Publication Data

US 2019/0125031 A1 May 2, 2019

(51) Int. Cl.

| | |
|---|---|
| ***A43B 13/18*** | (2006.01) |
| ***A43B 13/14*** | (2006.01) |
| ***A43B 13/22*** | (2006.01) |
| ***A43B 13/04*** | (2006.01) |
| ***A43B 13/12*** | (2006.01) |

(52) U.S. Cl.

CPC ..... *A43B 13/186* (2013.01); *A43B 13/04* (2013.01); *A43B 13/122* (2013.01); *A43B 13/141* (2013.01); *A43B 13/188* (2013.01); *A43B 13/223* (2013.01)

(58) Field of Classification Search

CPC ..... A43B 13/141; A43B 13/186; A43B 13/18; A43B 13/188; A43B 13/223

See application file for complete search history.

(56) References Cited

U.S. PATENT DOCUMENTS 4,141,158 A * 2/1979 Benseler ..... A43B 13/223 36/32 R
4,570,362 A * 2/1986 Vermonet ..... A43B 13/223 152/209.18

(Continued)

OTHER PUBLICATIONS

Hush Puppies Bilal Patterson, http://www.hushpuppies.com/US/en/bilal-patterson/883799677208.html?CID=MAR-Hush-Puppies-G-Shopping-Bilal-Patterson&CAWELAID=120144290000316810&CAGPSPN=pla&CAAGID=36835366242&CATCI=aud-253048239173tpla-60512637292&gclid=EAIalQobChMI1PHbpe3_1gIVBAaGCh2-IQX4EAQYAiABEgLQj_D_BwE (downloaded Oct. 23, 2017).

(Continued)

*Primary Examiner* — Ted Kavanaugh
(74) *Attorney, Agent, or Firm* — Warner Norcross + Judd LLP

(57) ABSTRACT

A footwear configured to attenuate shock and provide rebound is provided, including an outsole having independent compression pods separated from an outer support perimeter by a peripheral groove and from one another by multiple transverse grooves that are deeper than the peripheral groove. The pods can extend from a medial side to a lateral side, across a majority of an outsole width. The pods can compress individually and forwardly as the footwear engages the ground, and can rebound, providing energy return. The pods can independently compress medially and/or laterally to provide enhanced side to side flexibility of the outsole and attendant cushioning. The transverse grooves can be deeper than the thickness of the lower walls of the pods so that those lower walls can compress deeply upward and into the outsole to provide shock attenuation. A cushion unit can be adjacent those surfaces and can further provide rebound.

20 Claims, 8 Drawing Sheets

(56) References Cited

U.S. PATENT DOCUMENTS

| | | | | |
|---|---|---|---|---|
| 4,777,738 | A * | 10/1988 | Giese | A43B 5/08 36/116 |
| 5,216,824 | A | 6/1993 | Bissett et al. | |
| 5,918,385 | A | 7/1999 | Sessa | |
| 7,313,875 | B2 | 1/2008 | Morgan | |
| 8,127,468 | B2 | 3/2012 | Morgan | |
| 8,307,569 | B2 | 11/2012 | McInnis et al. | |
| 8,424,221 | B2 | 4/2013 | Litchfield et al. | |
| 8,713,817 | B2 | 5/2014 | Litchfield et al. | |
| 2006/0016100 | A1* | 1/2006 | Riha | A43B 13/141 36/59 R |

OTHER PUBLICATIONS

Hush Puppies Power Walker, https://www.6pm.com/p/hush-puppies-power-walker-ii/product/7441183 (downloaded Oct. 23, 2017).
Hush Puppies Roland Jester, https://www.6pm.com/p/hush-puppies-roland-jester/product/8647219 (downloaded Oct. 23, 2017).

* cited by examiner

CUSHIONING SYSTEM FOR FOOTWEAR

BACKGROUND

The present invention relates to footwear and, more particularly, to a footwear construction having improved shock attenuation, flexibility and energy return.

In the footwear industry, there is an ongoing effort to produce footwear having exceptional cushioning capabilities and shock attenuation. The need to produce such a cushioning system is particularly pronounced in the design of work, walking and athletic footwear, where increased cushion and rebound are primary objectives. For example, to minimize the effects of standing and walking on hard surfaces such as concrete floors, some footwear manufacturers manufacture specialty footwear that cushions the wearer's foot, particularly the heel, from the hard surface.

One example of specialty cushioning footwear is disclosed in U.S. Pat. No. 5,216,824, assigned to Wolverine World Wide, Inc. This patent discloses a walking shoe having a thick, unitary, cushioned sole having two integral protrusions in the heel and forefoot. These two protrusions are each surrounded by separate, deep grooves that isolate the respective heel and forefoot protrusions and their vertical movement relative to a peripheral ledge. This construction of the sole allows those protrusions to sink upward, into the sole a certain amount and then rebound to respectively provide some shock attenuation and toe off efficiency. While this provides cushioning and energy return to the wearer, the monolithic sole and the two protrusions sometimes can be too rigid, which impairs its ability to be laterally flexible and to provide medial to lateral, or vice versa, compression. The configuration of the two protrusions and the respective surrounding grooves sometimes can impair adequate vertical compression.

Although conventional cushioning systems can provide cushioning and energy return, there remains a long felt and unmet need for a footwear construction that provides these features as well as inherent flexibility and suppleness of the sole to enhance comfort of the footwear.

SUMMARY OF THE INVENTION

A footwear configured to attenuate shock and provide rebound is provided, including an outsole having independent compression pods separated from an outer support perimeter by a peripheral groove and from one another by multiple transverse grooves that can be deeper than the peripheral groove. The pods can extend from a medial side to a lateral side, across a majority of an outsole width. The pods can compress individually and forwardly as the footwear engages the ground, and can rebound, providing energy return. The pods also can independently compress medially and/or laterally to provide enhanced side to side flexibility of the outsole and corresponding cushioning and comfort.

In one embodiment, the transverse grooves can be deeper than the thickness of lower walls of the pods so that those lower walls can compress deeply upward and into the outsole to provide shock attenuation upon strike of the pods with a ground surface.

In another embodiment, the transverse grooves can extend laterally, across a majority of the width of the sole. The transverse grooves can intersect the peripheral groove in multiple locations along the lateral and medial sides of the footwear. The transverse grooves can visibly extend below a support perimeter from a side view of the footwear disposed on a ground surface.

In yet another embodiment, the outsole can include a resilient, flexible shell bounded by a sidewall having a first thickness. The sidewall can transition to a support perimeter having a lower support perimeter surface that generally surrounds the compression pods but it is disposed at a level higher than the lower, ground contacting surfaces of the respective compression pods. When the pods are fully compressed, the lower support perimeter surface and the lower ground contacting surface of the compression pods can be at the same level to provide support.

In still another embodiment, each of multiple compression pods, aligned one in front of the other in the forefoot and/or heel regions of the footwear, is configured to compress upward on at least one of the lateral side and the medial side. A compression pod lower wall bottom surface can move upward within the outsole, toward a level or elevation equal to that of the lower support perimeter surface, upon application of at least one of a lateral compression force and a medial compression force. Optionally, each individual compression pod can tilt laterally or medially, or vice versa, so that the lower wall bottom surface is at a higher level on the medial side than on the lateral side, or vice versa. Each pod can tilt in this manner, independent of all the other pods due to the separation of the pods via the transverse grooves adjacent the pods, and in some cases, due to the peripheral groove located adjacent the lateral and medial edges of the respective pods.

In even another embodiment, the outsole can be constructed to include a thin, flexible, resilient shell, optionally made from rubber or some synthetic or other natural material. The shell can extend through and can form the contours of the compression pods and the respective walls thereof. For example the shell can form a compression pod lower wall. The shell can be configured so that its thickness in that lower wall is less than a depth of a corresponding adjacent or nearby transverse groove. In some cases, with this disparity between the transverse groove depth and the thickness of the shell, flexibility can be enhanced.

In a further embodiment, the shell can include a bridge that extends between and connects lower walls of adjacent compression pods. The bridge can extend above the respective transverse groove, between adjacent pods, to connect the relatively thin lower walls of the pod and shell to one another.

In yet a further embodiment, the footwear can include a cushion unit disposed in the shell. The cushion unit can be constructed from a second material different from the material from which the shell is constructed. The cushion unit can include a varying thickness, which optionally increases from heel-to-toe in the footwear. Optionally, where separate groups of compression pods are located in the heel and the forefoot regions, the cushion unit can be divided into separate forefoot and heel region units that are disconnected from one another. Each of the respective cushion units can vary in thickness without regard to one another from heel-to-toe, optionally becoming thinner toward the toe.

In still a further embodiment, the cushion unit can include bottom or lower surfaces that engage the lower walls of the respective underlying compression pods. These cushion unit lower surfaces can be disposed below a bottom of a corresponding transverse groove disposed between adjacent compression pods. The cushion units optionally can include bridge recesses within which the bridges of the thin shell and portions of the respective transverse grooves are disposed to minimize the profile of the outsole.

The current embodiments provide a novel footwear construction including an outsole that is flexible from side to side, yet can attenuate shock and provide exceptional cushioning.

These and other objects, advantages and features of the invention will be more readily understood and appreciated by reference to the detailed description of the preferred embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENT

Figure 1:
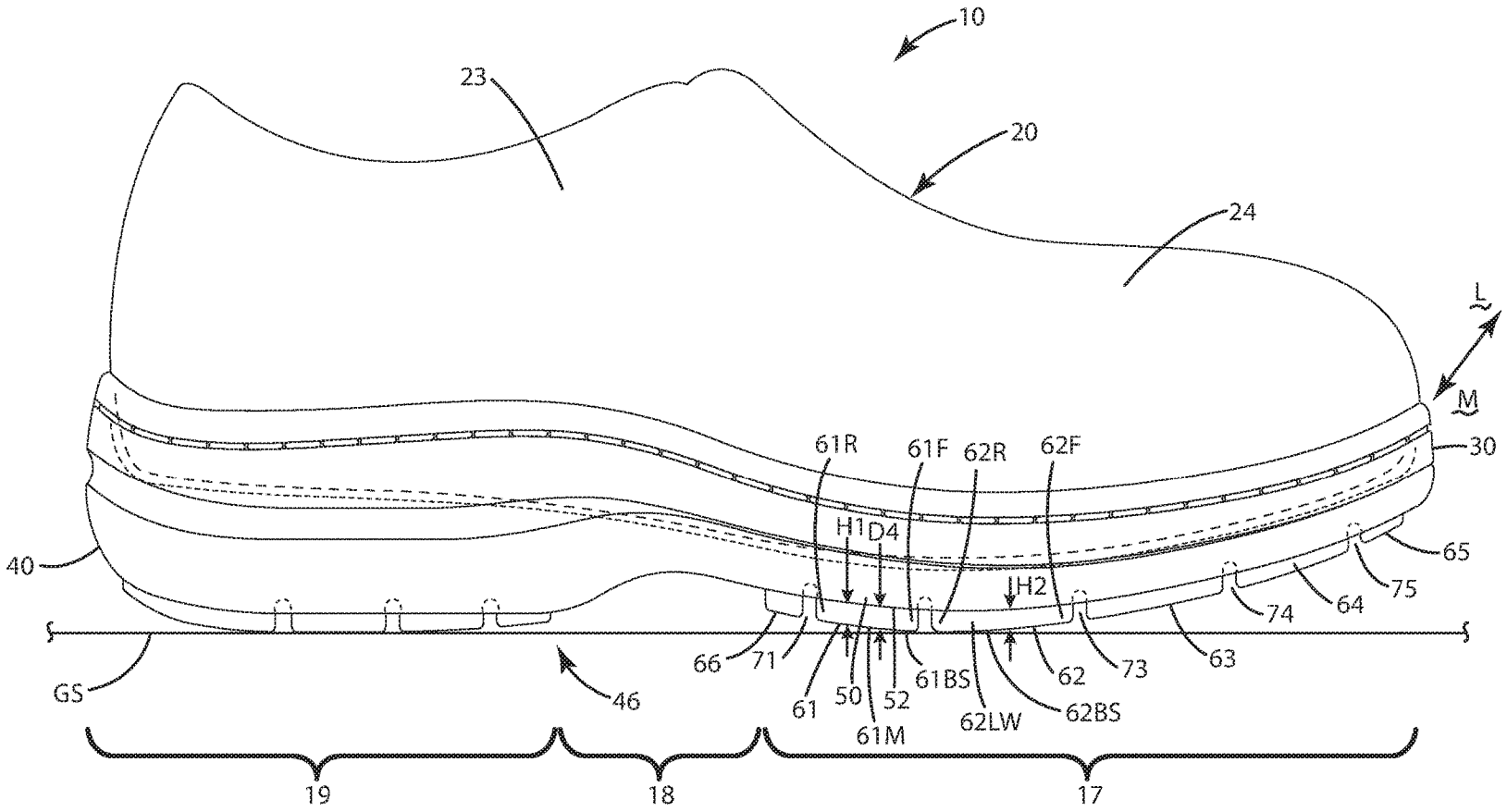
FIG. 1 is a side view of a current embodiment of the footwear.

Footwear constructed in accordance with a current embodiment is shown in FIGS. 1-8 and generally designated 10. Generally, the footwear 10 includes an upper 20 in an outsole 30 joined with the upper. The outsole 30 can include a longitudinal axis LA and a width W1, the width W1 spanning from a lateral side L to a medial side M across the longitudinal axis LA. The outsole 30 can include a resilient, flexible shell 40 bounded by sidewall 42 that transitions to a support perimeter 50 having a lower support perimeter surface 52. The outsole can include a first set 31 of compression pods in the forefoot region 17, and a second set 32 of compression pods in the heel region 19. The sets of pods can function independent of one another, but in addition, multiple individual compression pods, for example 61-66 or 61'-64', can compress and rebound forwardly and rearwardly, as well as laterally and medially in a tilting manner, independent of one another, due to their separation and isolation via a system of complex grooves, including a peripheral groove 53 and one or more transverse grooves 71-75 or 71'-73'.

Although the current embodiment of footwear is illustrated in the context of a casual shoe, it may be incorporated into any type or style of footwear, including performance shoes, hiking shoes, trail shoes and boots, hiking boots, work boots, all-terrain shoes, barefoot running shoes, athletic shoes, running shoes, sneakers, conventional tennis shoes, walking shoes, multisport footwear, boots, dress shoes or any other type of footwear or footwear components. It also should be noted that directional terms, such as "vertical," "horizontal," "top," "bottom," "upper," "lower," "inner," "inwardly," "outer", "outwardly," "below" and "above" are used to assist in describing the embodiments based on the orientation of the embodiments shown in the illustrations.

Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 17, arch region or mid-foot region 18 and heel region 19 generally are identified in FIG. 1. However, it is to be understood that delineation of these regions may vary depending upon the configuration of the sole assembly and/or footwear.

The upper 20 will only be described briefly here. It can include a quarter 23 and a vamp 24. The upper 20 can terminate in the lower peripheral allowance 25, which can be attached via stitching to a Strobel board 22, which generally closes the bottom of the upper 20. Alternatively, the upper can be placed on a last, attached to an insole (not shown) with cement or adhesive to close the bottom of the upper, with the sole further adhered to the lasted upper, which results in a permanent bond between the upper, insole and outsole, with no stitching. Where optionally included, the Strobel board 22 can extend over the respective cushion unit 80, concealing the cushion unit from view through the interior of the upper 20. The upper 20 can be manufactured from leather, canvas, nylon, knitted or woven fabric or other suitable materials, and may include a liner (not shown) or other conventional accessories. Optionally, although not shown, the footwear can include a footbed or insole disposed above the Strobel board, or cement lasted construction mentioned above, associated with the upper 20.

Figure 3:
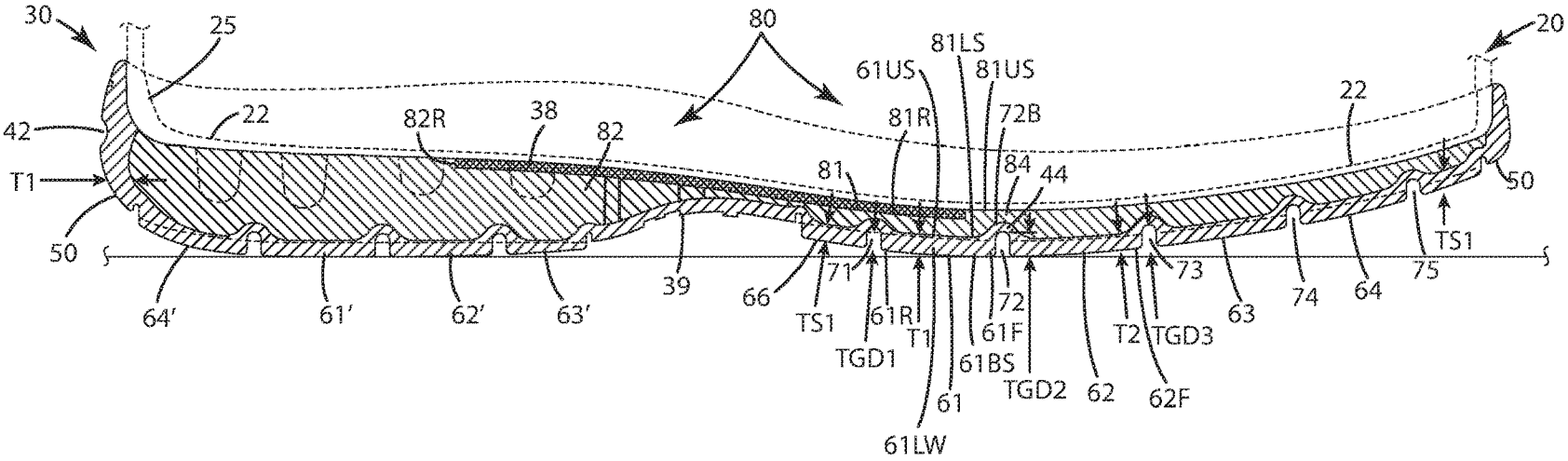
FIG. 3 is a section view of the footwear taken along line 3-3 of FIG. 2.
Figure 5:
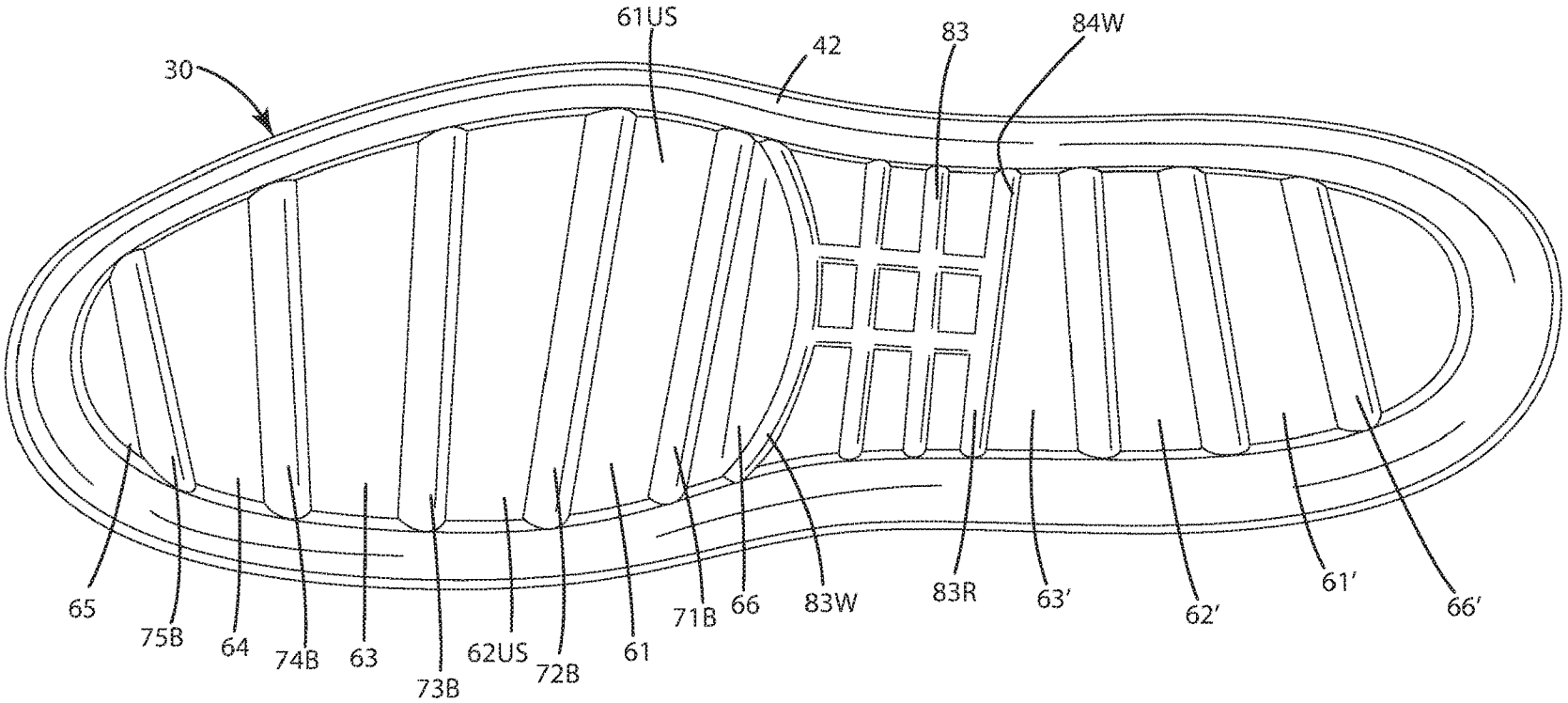
FIG. 5 is a top view of an outsole shell of the footwear before the outsole shell is joined with other components of the footwear.

In some constructions, the footwear 10 can include a shank 38 that spans through the arch region 18, and optionally into a portion of the heel region 19 and forefoot region 17. As shown in FIGS. 1, 3 and 5, the shank 38 can span over the arch, which can include compartmentalized voids having a lattice structure to reinforce the arch 39 there. The shank 38 can be disposed within a recess 81R and 82R of the cushion unit 80 to provide a lower profile for that structure below the Strobel board. The shank 38 can cross over a forward wall 83W of the arch 39, and a rearward wall 83R of the arch 39. These walls can coincide with the location of transverse grooves of respective heel and forefoot sets of compression pods, as shown in FIG. 5. Optionally, with the wall 83W placed there, it aligns with the rearmost part 53R of the peripheral groove 53. The wall 83R also can align with a front part of 53F' of the peripheral grove 53 that surrounds the rear set 32 of the compression pods. With the supports and walls so placed, they generally do not interfere with the compression of the compression pods in the forefoot region or the heel region, and can facilitate flexing of the outsole in these locations. The shank can be of a unitary construction that adds torsional strength in the heel region and/or rigidity to the footwear 10 in general. The shank 38 can be constructed from plastic, metal or synthetic materials that may be secured under the Strobel board or generally within the outsole to add rigidity as desired.

The outsole 30 as illustrated in FIGS. 3-7 can include multiple components. To begin, the outsole can comprise a resilient, flexible shell 40 bounded by sidewalls 42. The shell can be flexible by virtue of its material construction. For example, the shell can be constructed from rubber, synthetic or natural, thermoplastic polyurethane, polymers, and/or sufficiently durable and wear-resistant material, for example, polyurethane, polyvinyl chloride, or thermoplastic rubber. The shell 40 can include a lower ground contacting surface 46 that is configured to contact the ground surface GS underfoot. The lower ground contacting surface 46 can be contoured to define the desired heel and tread patterns. The surface 46 can be textured or treaded to improve the traction and esthetic appeal of the footwear. As described in further detail below, the surface 46 can be segmented and associated with the lower surfaces of independent compression pods, however, those pods themselves generally are not regarded as part of a tread or texture.

As mentioned above, the outsole 30, in particular the resilient flexible shell includes a sidewall 42 that transitions to a support perimeter 50 having a lower support perimeter surface 52. The support perimeter 50 can be in the form of a thicker portion of the shell so that it does not compress or deform as easily as the compression pods as described below. This support perimeter 50 thus can serve as a bottom or support wall that arrests the compression of the outsole after one or more compression pods compresses a suitable amount during a shock attenuation event or activity with the footwear in general. Optionally, the resilient shell can be between 1.5 mm and 6.5 mm, inclusive, thick throughout the shell. In the support perimeter 50, the thickness can be at the higher end of this range to provide a "hard stop" during compression of the pods to thereby arrest further compression of the outsole.

As mentioned above, the shell 40 can form and/or include one or more front 31 or rear 32 sets of compression pods 61-66 and 61'-64'. With reference to FIGS. 2-8, these pods will be described now more detail. It will be appreciated that the respective compression pods can be similar in structure, function and range of movement from one to the next, regardless of their general location. Therefore, only a few pods in the front 31 set of pods will be described in detail here. It will be further appreciated that the rear set 32 of pods 61-64' can be similar or virtually identical in structure and function. Optionally, however the rear pods 32 can include slightly thicker lower walls, particularly the rearmost pod 64', to withstand its repeated impact with the ground and the amount of abrasion that the pod is subject to. With the thicker lower pod wall, this pod can attenuate and dissipate the forces from heel strike during a gait cycle more evenly and suitably throughout the heel region.

Further optionally, with regard to the sense of pods, the thickness of the pods from a front pod to a rear pod of a set can vary. For example, with regard to the front set 31 of pods, that set can include a front pod 65 the rear pod 66. The rear pod 66 typically is the first pod to engage the ground during normal gait. The front pod 65 is the last pod to engage the ground. The front pod 65, however, is also the last pod to touch the ground during toe off as compared to the rear pod 66. Optionally, the rear pod 66 can include a first thickness TS1 at its bottom, for example, the bottom wall of that pod which is formed by a portion of the shell can have thickness TS1. That thickness can be optionally 4.5 mm to 6.5 mm, inclusive, further optionally 5.0 mm to 7.5 mm, inclusive, yet further optionally about 6.0 mm inclusive. Front pod 65 can include a second thickness TS2 at its bottom, for example, the bottom wall of that pod, which is formed by a portion of the shell, can have a thickness TS2. That second thickness TS2 can be optionally 1.5 mm to 4.0 mm, inclusive, further optionally 1.5 mm to 3.0 mm, inclusive, yet further optionally 3.0 mm to 3.5 mm, inclusive. Optionally, the first thickness TS1 can be greater than the second thickness TS2 of the respective front and rear pods. In this manner, the greater thickness in the rear can provide for more shock absorption than the second thickness in the front. This can be particularly true for the rear set of pods 32, where the rearmost pod 64 generally is the first to strike the ground under force upon contact of the footwear with a ground surface during normal gait cycle. Again, with this thicker portion of the shell and the thicker pod bottom wall in this region, this can attenuate the shock, dissipating it over a larger surface area of the pod, the pod set, the outsole, and generally the heel region.

Turning now to the compression pods 61-66, which are presented here as an example, these pods can each extend across the majority of the width W1 in the location where those pods are located. Generally the width W1 is transverse to longitudinal axis LA. By the majority of the width W1, it is meant that the pods can extend across at least 60%, further optionally at least 70%, yet further optionally at least 80%, yet further optionally at least 85%, yet further optionally at least 90%, still further optionally at least 95% of the width W1 where those pods are located.

Each of the compression pods can include a compression pod lower wall. An example of this is the compression pod lower wall 61W of the first compression pod 61. This compression pod lower wall 61W can include an upper surface 61US disposed above a bottom surface 61BS. The bottom surface 61BS can correspond to the surface 46 of the outsole and form a portion of it. It also can include tread or textures for traction. The first compression pod lower wall 61LW can have a first thickness T1. The first thickness T1 can extend between the first compression pod lower wall bottom surface 61BS and the first compression pod lower wall upper surface 61US. This thickness T1 can be optionally 1.0 mm to 6.5 mm, inclusive, optionally 1.5 mm to 4.0 mm, inclusive, further optionally 1.5 mm to 3.0 mm, inclusive, yet further optionally 3.0 mm to 3.5 mm, inclusive, or any of the other thicknesses mentioned above in connection with the front pod and rear pod. Optionally the thickness can be about 3.5 mm in this particular pod in some applications. In other applications, the first compression pod lower wall 61LW first thickness T1 can be at least 2.0 mm. The second compression pod 62 can include a lower wall similar in structure with a similar pod lower wall 62LW having a second thickness T2 that is also at least 2.0 mm. Of course, it can have a thickness T2 similar to any of those claims mentioned in connection with T1.

Each of the compression pods, and optionally each set of pods can be surrounded by a common peripheral groove. For example, the front pod set 31 can be surrounded by common peripheral groove 53 having a peripheral groove depth PGD. Optionally, the first compression pod 61 is disposed on an interior of the common peripheral groove 53, and disposed across from the peripheral support 50. The peripheral groove depth PGD can be measured from the lower support perimeter surface 52 upward, that is, away from the ground surface GS, to a bottom 53B of the common peripheral groove 53. The peripheral groove depth PGD can be optionally 1.0 mm to 4.0 mm, inclusive, further optionally 2.0 mm to 3.5 mm, inclusive, yet further optionally 1.5 mm to 2.5 mm inclusive. In some cases, the peripheral groove depth PGD can be variable from the rear pod 66 to the front pod 65. For example, the depth of the peripheral groove 53 can vary and can become shallower as it transitions forward generally along the longitudinal axis. Of course, in the application shown, the groove depth PGD can be substantially the same depth from the rear pod 66 to the front pod 65.

Figure 2:
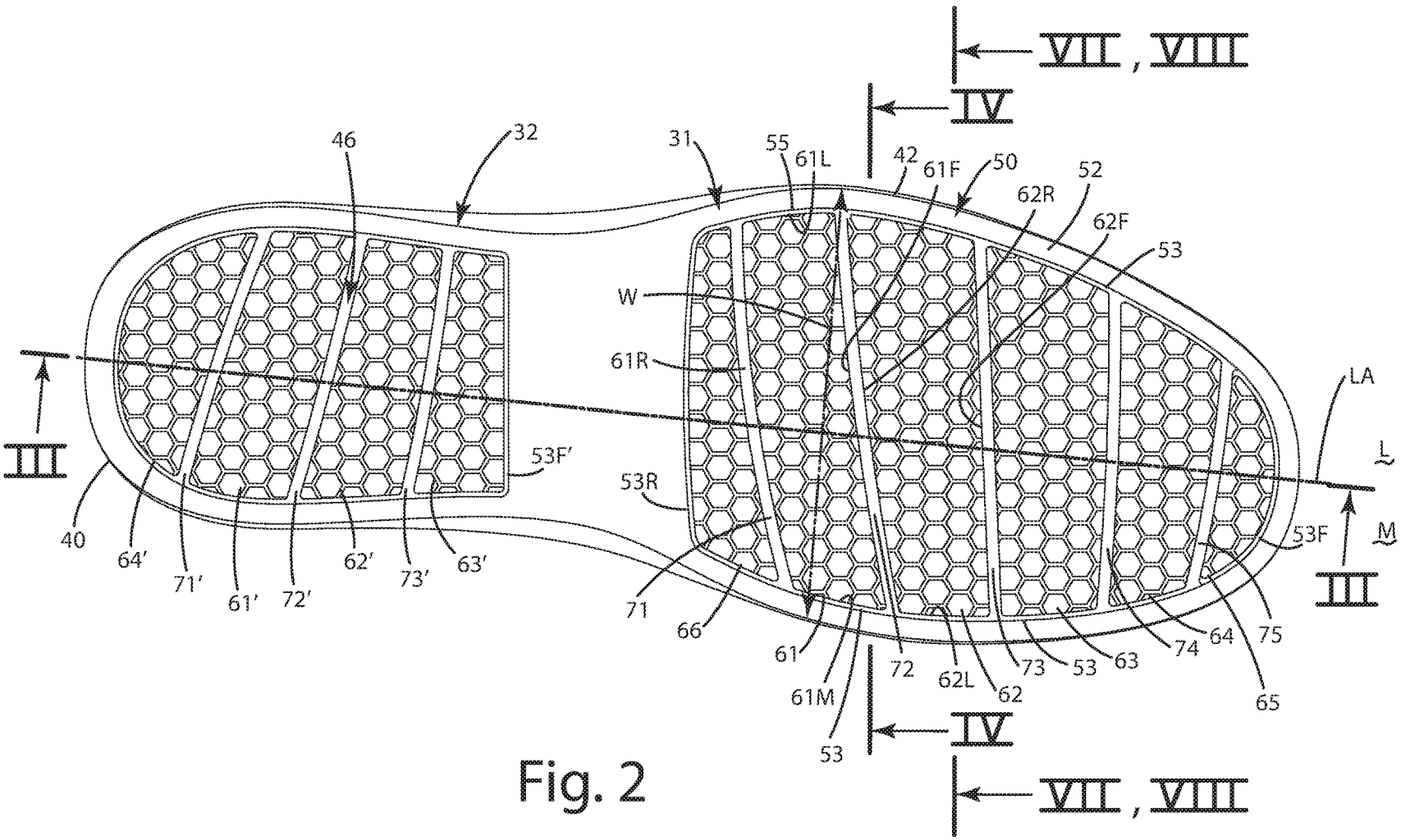
FIG. 2 is bottom view of the footwear.

As shown in FIG. 2, the common peripheral groove 53 also can extend rearwardly behind or rearward of the rearward compression pod 66. There, the common peripheral groove can include a rear portion 53R of the groove 53. Forward of the front pod 65, the groove 53 can include a front portion 53F. These front and rear portions 53R and 53F of the common peripheral groove 53 can join the lateral side portions 53 and medial side portions 53 of the common peripheral groove on opposite sides longitudinal axis LA. Thus, the common peripheral groove can substantially surround the first set 31 of compression pods. The groove can be substantially continuous without being interrupted by any other structures. This can enable the respective pods within the common peripheral groove to move independently of the surrounding perimeter support 50. Of course, in some applications, the groove 53 can be interrupted in certain locations to provide stability and/or other functionality to the outsole.

Figure 4:
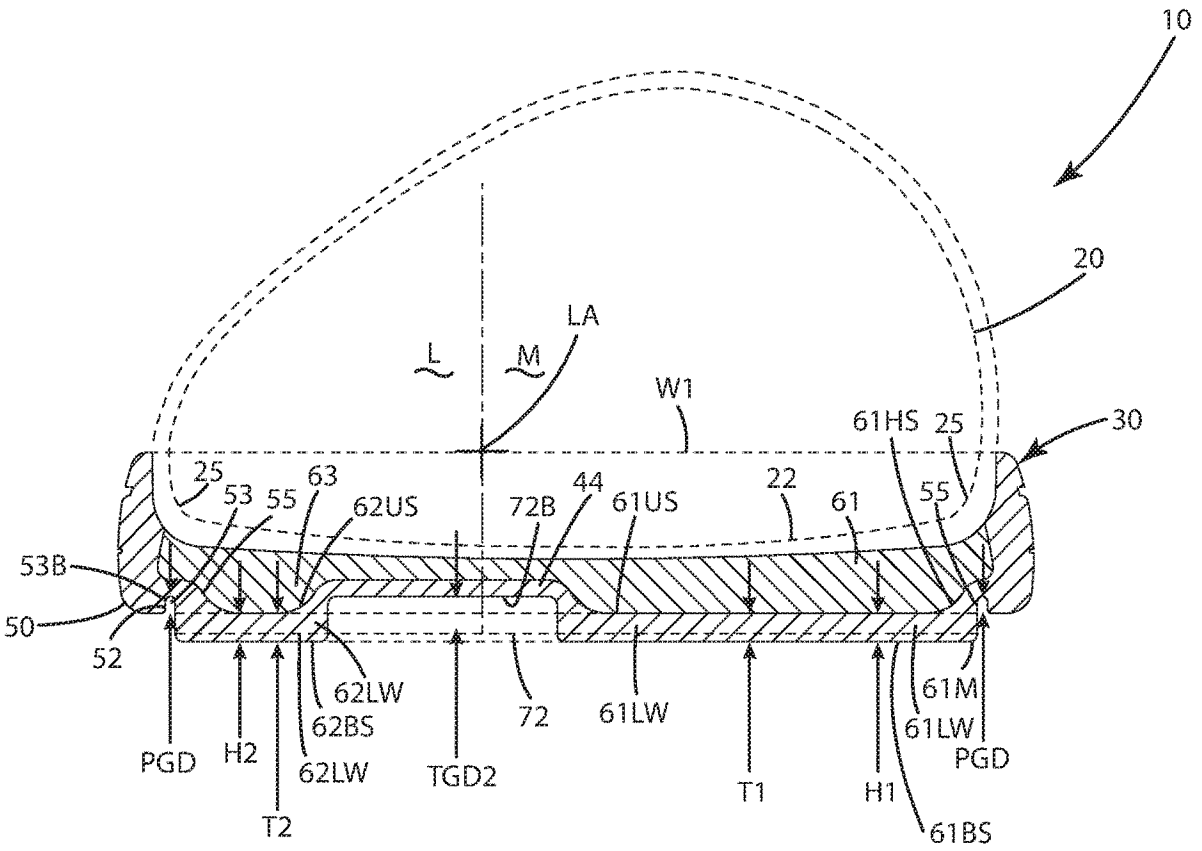
FIG. 4 is a section view of the footwear taken along line 4-4 of FIG. 2.
Figure 7:
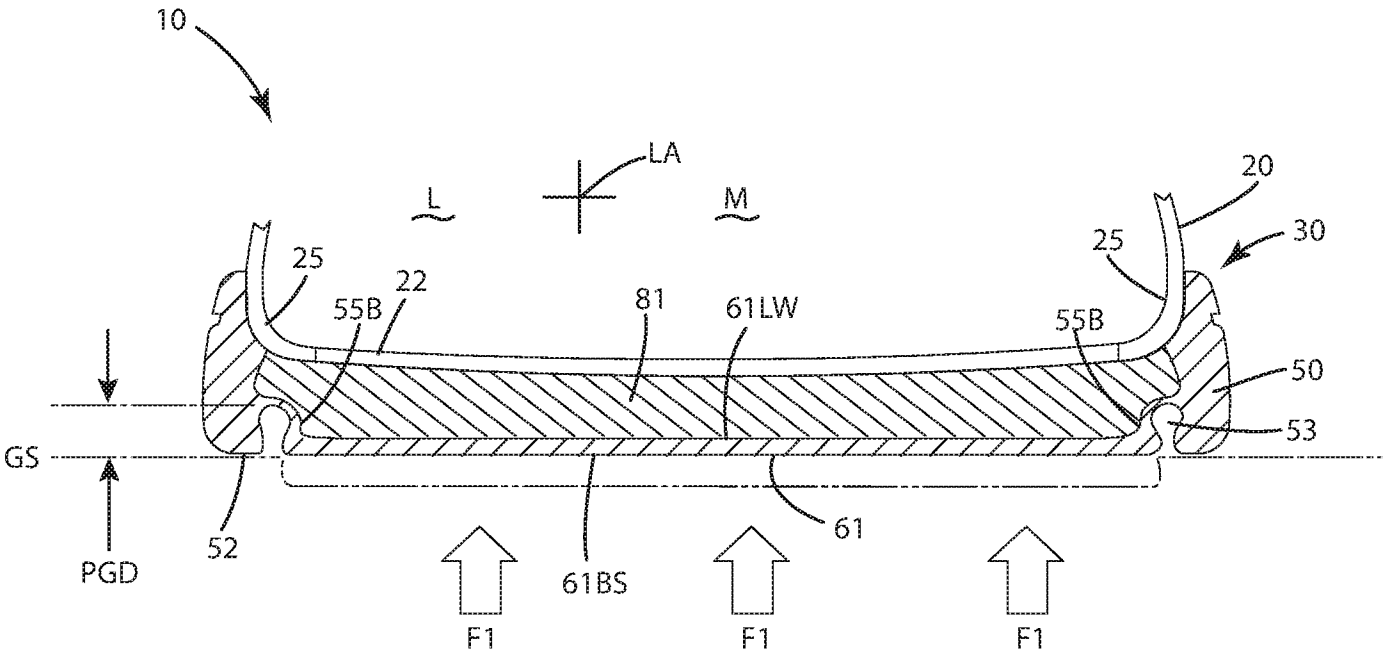
FIG. 7 is a section view of the footwear taken along line 7-7 of FIG. 2 illustrating compression of a compression pod under force.

As shown in FIGS. 1 and 4, the compression pod 61-66 each can have a height extending downward below the lower support perimeter surface 52. For example, the first compression pod 61 can include a height H1 that is substantially equal to the peripheral groove depth PGD where that groove adjacent that compression pod, that is, H1=PGD in some cases. In this manner, the compression pod 61 can extend above the support perimeter surface 52 an amount equal to the amount by which the compression pod and associated sidewall extends downward into the peripheral groove to the peripheral groove depth PGD, to the peripheral groove bottom 53B. In some applications, this can result in the entire height of each one of the compression pod being retracted into, extending upwardly into, or hidden in the sole the depth of the peripheral groove. The perimeter support surface 52 and the lower surface 61LS of compression pod 61 can be at the same level, for example, at the ground surface and engaging the ground surface as shown in FIG. 7, when the compression pod is compressed under force.

As further shown in FIGS. 1, 3, and 4, each of the respective compression pods in a set can be separated by one or more transverse grooves 71-75. These transverse grooves can be substantially similar to one another, so only one of them will be described here. For example, the first transverse groove 71 extends across a majority of the width W1 and across the longitudinal axis LA. The transverse groove can each include a transverse groove depth, for example TGD1 and TGD2. Referring to transverse grooves 71, 72 these transverse groove depths can be substantially equal to the peripheral groove depth PGD plus the height H1 or H2 of an adjacent compression pod 61 or 62, respectively. Optionally, TGD2=H2+PGD, and/or TGD1=H1+PGD in some applications.

There can be a number of relationships between the depths of the transverse grooves and other components of the outsole to enhance flexibility. For example, the transverse groove depth TGD2 can be greater than the thickness T1 of the shell 40 in the compression pod lower wall 61LW, or generally the thickness T1 of the shell in that region, between the bottom surface 61BS and the upper surface 61US of the lower wall 61LW. The depth TGD2 can be such that the upper surface 61US of the lower wall 61LW is at an elevation that is below or lower than the bottom 72B of the transverse grooves 72. Indeed, the upper surface 61US can be below this bottom 72B by optionally 0.1 mm to 1.0 mm, inclusive, further optionally 0.5 mm to 2.0 mm, inclusive, or other distances, depending on the desired flexibility of the pods relative to one another.

Optionally, the pods themselves can be integral with one another despite being separated by the transverse grooves. For example, flexible shell 40 can include a bridge 44, which is located above the transverse groove 72, and that extends above the lower wall upper surface 61US. This bridge 44 can span from a lower wall 61LW first compression pod 61 to another lower wall 62LW of a second compression pod 62. The bridge can be in the form of and can surround the transverse groove 72. In some cases, the bridge 44 can be in the form of a "U" or "V", with sidewalls that intersect front and rear edges of adjacent compression pods as described further detail below. This bridge 44 also can bound the bottom 72B of the transverse groove 72.

The transverse grooves 71-75 also can be configured to extend laterally and medially away from the longitudinal axis LA. Eventually, these grooves intersect the common peripheral groove 53 on the lateral side L and the medial side M. The transverse groove depth TGD1 and TGD2 of the grooves can extend continuously downward, below the lower support perimeter surface 52 and even beyond a compression pod lower wall bottom surface 61BS, 62BS. For example, as shown in FIGS. 1 and 3, the groove 71 extends downward, below the bottom surface lower support surface 52, and is visible via the side view shown there. While a viewer can view the transverse groove 71 below the surface 52, the intersected common peripheral groove 53 is not visible to a viewer in this side view. That is because that common peripheral groove 53 ends at the lower perimeter support surface 52, projecting upwardly into the outsole.

Optionally, at the intersection of the transverse grooves and peripheral groove, the transverse grooves can be approximately 1.25, 1.5, or 2.0 times the depth PGD of the common peripheral groove. In most cases, the ratio of the depth PGD of the common peripheral groove relative to the corresponding transverse groove depth T, TGD1, or TGD2 can be optionally 1:2, further optionally 1:2.5. In each set of the compression pods, the depth of the common peripheral groove 53 on the lateral and medial sides of a pod can be less transverse groove depth with regard to each respective compression pod. Of course, where the common peripheral groove 53 becomes progressively deeper from toe-to-heel, the transverse grooves can likewise become deeper in the above-noted ratio of 1:2 or some other desired ratio.

The common peripheral groove 53 defined in the shell 40 can be configured to include an interior sidewall 55. As shown to the right of FIG. 8, that interior sidewall 55 can be generally outwardly angled relative to the ground surface GS at angle A1. This angle can be a right angle, further optionally an acute angle, yet further optionally an angle between 1° and 89°, yet further optionally an angle between 45° to 85°. It will be noted that to the right of FIG. 8, the compression pod 62 is not yet compressed on the medial side M. To the left of FIG. 8, however, a lateral force LF1 has been applied to the bottom surface 62BS of the compression pod 62 there, for example, during a roll of the footwear or the stepping on uneven ground surface GS. During this force application, the interior sidewall 55 defined by the shell adjacent the groove 53 on the lateral side can bend, bow, flex or otherwise deform due to the thickness of the shell and sidewall in that region.

Optionally, the interior sidewall can be outwardly angled as the interior sidewall extends upward, away from the ground surface, becoming farther away from the longitudinal axis as it transitions upward. In some cases, the interior sidewall can be optionally less than 2.5 mm in thickness, yet further optionally less than 2.0 mm in thickness, further optionally less than 1.5 mm in thickness. This thin thickness, as well as the shape and contour of the interior sidewall, can enable it to bend, flex, bow, angle and/or otherwise deform so that the compression pod 61 can compress upwardly into the outsole until the lower support perimeter surface 52 of the perimeter support 50 engages a ground surface GS, along with the first compression pod lower wall bottom surface 61BS.

An example of compression of a compression pod is illustrated in FIG. 7. This compression is experienced by the footwear 10 during normal walking on flat ground, without pronation or supination of the foot within the footwear 10. During a gait cycle, a force F1 is exerted generally evenly by the ground surface GS across the bottom surface 61BS of the pod 61. This force F1 pushes upward on the lower wall 61LW of the pod. The cushion 81 compresses. The respective interior sidewalls 55B also flex, bend or otherwise deform as illustrated there in some other manner. This flexing or bending can be facilitated by the interior sidewall already being at an outward angle as shown and described. This flexing or bending or deformation enables the interior sidewalls to offer little to no structural support during the compressing of compression pod 61. The compression pod thus continues to compress until the ground surface is contacted by the lower support perimeter support surface 52 on the lateral and medial sides of the footwear. Due to the relatively stout and rigid structure of the perimeter support 50, this arrests further compression of compression pod 61 into the outsole 30. As a result, the compression of that pod ceases. When the footwear disengages or begins to discourage the ground surface GS, however, the energy stored in the cushion and the flexed, bent or deformed interior sidewall is returned to the user as the compression pod extends, to provide efficient toe off and continuance of the gait cycle.

Figure 8:
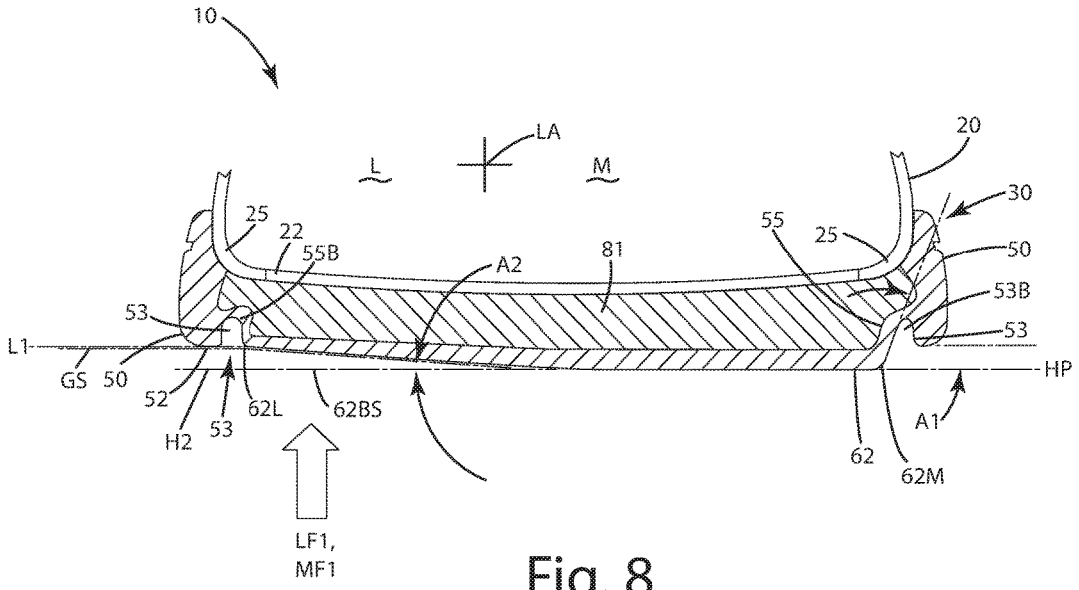
FIG. 8 is a section view of the footwear taken along line 8-8 of FIG. 2 illustrating lateral to medial compression, or side to side tilting, of a compression pod of the footwear.

The respective interior sidewalls 55 of each compression pod, in combination with the transverse grooves also can provide independent tilting of the compression pods relative to one another. For example, as shown in FIG. 8, the compression pod 62 flexes upward on the lateral side L so that the lateral edge 62L of the pod 62 becomes even with the lower perimeter surface 52, generally at the same level LI. In this manner, the compression pod 62 tilts, optionally about the longitudinal axis, further optionally about an axis generally parallel to the longitudinal axis and/or dynamically an angle A2. This angle A2 can be an acute angle, optionally 1° to about 15°, further optionally about 2° to about 10°, yet further optionally about 2° to 5° relative to a horizontal plane HP. Again, this tilting of the compression pod 62 can be due to the compression pod receding into the outsole 50 due to a lateral force LF1, or if the force was on the other side as a medial force MF1, in the other direction. As a result, the compression pod can exhibit independent side-to-side compression, so that the pod's movement and partial compression on the lateral side is generally independent of the pod, movement or compression on the medial side of the compression pod. Again, the respective interior sidewall 55B on the one side can bend, flex or deform, while the opposing opposite sidewall 55 does not substantially bend, or does not bend as much. It is noted that each of the compression pods, for example, the first 61, second 62, and thirds 63, fourth 64, fifth 65 etc., can tilt independently of one another due to their separation by the respective transverse grooves 71-75. As a result, exemplary first compression pod 61 and second compression pod 62 can flex upward on the lateral side and/or the medial side L substantially independent of one another due to the separation via the second 72 groove. In this manner, the respective compression pods can conform the contours of the ground surface GS underfoot. This can provide flexibility to the outsole and generally better stability, yet still provide adequate cushioning and energy return via the compression pods. It will also be appreciated that the second compression pod 62 and the third compression pod 63 likewise are configured flex upward on the lateral side and/or upward on the medial side in a like manner, independent of one another due to the separation be the third transverse groove 73. Again, with this configuration and the independent ability to flex laterally, the compression pods can independently yield to various lateral compression forces, which can increase the overall flexibility of the outsole.

As mentioned above, the transverse grooves can include transverse groove depths. Optionally, these depths are greater than respective common peripheral groove depths adjacent the respective compression pod. Put another way, the common peripheral groove 53 adjacent a respective compression pod can be shallower than the respective transverse groove also adjacent that same compression pod. For example, with regard to the first 61, second 62 and third 63 compression pods, which are partially surrounded by the common peripheral groove 53, that groove 53 can be shallower than each of the second 72 and third 73 transverse grooves. This can be true for other pods adjacent the common peripheral groove 53, and whether the pods are located in the front set of compression pods or in the rear set of compression pods.

With reference to FIGS. 1, 2, and 3, the compression pods can include certain structural features that border the transverse grooves and respective parts of the common peripheral groove 53. For example, the first compression pod 61 can span the majority of the width W1. The first compression pod can include a first compression pod lower wall 61LW that has a first thickness T1. This first thickness T1 can extend between the first compression pod lower wall bottom surface 61BS and the upper surface 61US. The separation between these surfaces can be a first height H1. The first compression pod can include a first front edge 61F that transitions to a groove wall or the bridge that forms a portion of the second transverse groove 72. The first front edge 61F can span a majority of the width W1. The compression pod 61 can include a first rear edge 61R that also spans a majority of the width W1. The first rear edge 61R can be bounded by the first transverse groove 71 that is rearward of the compression pod. The first transverse groove 71 can include the first depth TGD1 as explained above. This can be greater than the first thickness T1. The second transverse groove 72 forward of the front edge 61F can have a second depth TGD2, explained above, that is greater than the first thickness T1 as well. The first compression pod 61 can include a first medial edge 61M that is bounded by a first medial groove which itself can be a portion of the common peripheral groove 53 adjacent the compression pod 61. The first lateral edge 61 can be bounded by a first lateral groove, which itself can be a portion of the common peripheral groove 53 adjacent the compression pod 61. The lower support perimeter surface 52 can be disposed opposite the first medial edge 61M, across the first medial groove, or generally the common peripheral groove 53. A lower support perimeter surface 52 on the opposite side, that is, the lateral side L can be disposed opposite the first lateral edge 61L, across the first lateral groove 52, which again can be a portion of the common peripheral groove 53. The first lateral groove 53 can have a third depth which can be peripheral groove depth PGD. The first lateral edge 61L can be disposed below the lower support perimeter surface 52 a third distance H1. This third distance H1 can be approximately equal to the third depth, that is, the peripheral groove depth PGD explained above. The first medial groove 53 can also have a fourth depth, which can correspond to the peripheral groove depth PGD adjacent that compression pod in that region. The first medial edge 61M can be disposed below the lower support perimeter surface 52 a fourth distance H1 which can be approximately equal to the fourth depth, that is, peripheral groove depth PGD. In this manner, the first compression pod lower wall bottom surface 61BS can be at an elevation below the lower perimeter surface 52 by the third distance H1 on the lateral side L and the fourth distance H1 on the medial side M. Again, generally the third and fourth distances H1 can be approximately the same when the shoe is in a static, unworn state. Of course, in some applications the distances H1 on opposing sides L or M can differ to address certain characteristics of the wearer's foot, for example, pronation and/or supination. Likewise, it will be appreciated that the peripheral groove depth PGD can vary depending on which compression pod that the peripheral groove is adjacent, on the lateral side or medial side, or in a front or rear pod. For example, in some cases the peripheral groove near the rear pods can be deeper than the peripheral groove near the front pods. In this case, the third distance H1 and the fourth distance H1 can be greater when the first compression pod is a rear pod than when the first compression pod is a pod near the toe. Optionally, the first transverse groove 71 can be deeper than the first lateral groove and the first meal groove, i.e. optionally deeper than the peripheral groove 53 in the lateral or medial regions where it is adjacent that first compression pod.

As mentioned above, within the sets of pods, for example, the front set 31, there can be multiple pods adjacent one another, generally aligned one after the other along the longitudinal axis LA, extending toward the toe. Accordingly, the features of the next or second compression pod 62 can be similar to that of the first compression pod the one described above. For example, the second compression pod 62 can be disposed forward of the first compression pod 61. The second compression pod (and any subsequent compression pods forward of the first or rear pods), can span a majority of the width W1 of the outsole from the medial side M to the lateral side L. The compression pod 62 can include a second compression pod lower wall 62LW that has a second thickness T2, as shown in FIG. 4. The second thickness T2 can extend between a second compression pod lower wall bottom surface 62BS and a second compression pod lower wall upper surface 62US. Again, the surfaces can simply be the opposite sides of the flexible shell 40 at the lower wall of the compression pod. The second compression pod lower bottom wall surface 62BS can extend below the lower support perimeter surface 52 a fifth distance H2. Optionally, this distance H2 can be equal to the distance H1 for the first compression pod. In some cases, it may be different, but optionally all the heights of the respective pods can be substantially the same or equal. Further optionally in some cases, the heights can be graduated so that pods closer to the toe have heights that are lesser than the heights of pods that are farther from the toe.

With reference to FIG. 2, the second compression pod 62 can include a second front edge 62F that spans a majority of the width W1, and a second rear edge 62R that also spans a majority of the width W1. The second rear edge 62R can be bounded by the second transverse groove 72, while the second front edge 62F can be bounded by third transverse groove 73. Thus, the second and third transverse grooves can be separated by the distance between the second rear edge 62R and the second front edge 62F. The third transverse groove 73 can include a fifth depth TGD3 that is optionally greater than the second thickness T2. This fifth depth TGD3 can be less than and/or equal to the depths TGD2 and TGD1.

The compression pod 62 also can include a second medial edge 62M bounded by a second medial groove 53. Again this second medial groove can be the peripheral groove adjacent that compression pod in that region of the footwear. The pod also can include a second lateral edge 62L bounded by a second lateral groove 53, which can be the peripheral groove on the opposite side of the footwear. The lower perimeter surface 52 can be disposed opposite the second medial edge 62M across the second medial groove 53 on the medial side M. Likewise the lower perimeter surface 52 on the lateral side L can be disposed opposite the second lateral edge 62L disposed across the second lateral groove 53 of the lateral side L of the footwear. The second lateral groove 62L can include a fifth depth, that is, the depth of the peripheral groove adjacent the compression pod on the lateral side L adjacent the second lateral edge 62L. This fifth depth can be the peripheral groove depth PGD of the peripheral groove in that location. The second lateral edge 62L extends below the lower support perimeter surface 52 a seventh distance H2. The seventh distance H2 again can be equal to the other distances or heights H1 of the first compression pod 61, or optionally distances similar to the extension of other compression pods, depending on the application. The seventh distance H2 can be approximately equal to the sixth depth of a second medial groove 53, that is, the peripheral groove depth PGD so that the second compression pod lower wall bottom surface 62BS lays below or at an elevation below the lower support perimeter surface 52 the sixth distance H2 on the lateral side L, and optionally also the seventh distance H2 on the medial side M. Optionally, the second transverse groove 72 can be deeper than the second lateral groove and the second medial groove 53, which again can be the common peripheral groove 53 on opposite lateral and medial sides respectively of the longitudinal axis.

As mentioned above, adjacent and/or distal compression pods are configured to flex upward and downward on the lateral side and/or the medial side, substantially independent of one another, even when the compression pods are in the same set of pods. This independent lateral compression or medial compression, which produces a tilting from side to side of the respective compression pods, can be due to the separation of the pods via a transverse grooves between them, as well as the characteristics of the thin flexible and resilient shell. Again as mentioned above, compression pods, such as the first 61 and second 62 compression pods can be separated from one another by a transverse groove, such as the second transverse groove. These pods also can be separated from the lower perimeter support by the respective first and second lateral medial grooves 53. This can effectively isolate the compression pods from one another, and can allow them to twist and tilt independent of one another on lateral and medial sides of the outsole.

Figure 6:
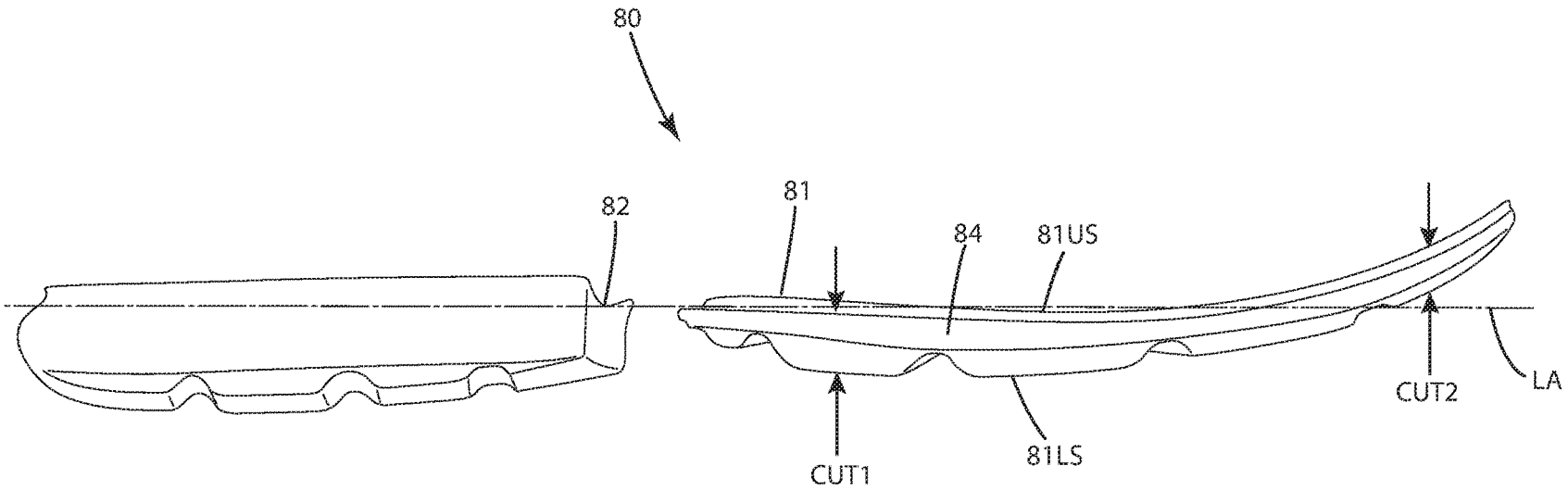
FIG. 6 is a side view of a multicomponent cushion unit of the footwear.

As mentioned above, the outsole can include a cushion unit 80. This cushion unit 80 can be disposed above one or more of the compression pods. Indeed, the cushion unit can include separate and independent front 81 and rear 82 units that extend over the respective front set 31 and rear set 32 of compression pods. Each of the respective cushions units 81 and 82 can be constructed from ethyl vinyl acetate (EVA), polyurethane, or other cushioning materials. As shown in FIG. 6, the respective cushion units 81 and 82 can include a thickness T that becomes progressively less as the cushion unit extends forward along the longitudinal axis LA from the rear pod toward the front pod. For example, this thickness can decrease from CUT1 to CUT2 from heel-to-toe.

The cushion unit 80 can be disposed above the compression pods, within the shell, and optionally well below the upper most portion of the shell 40. The cushion unit 80 parts, for example, cushion unit 81 can include a cushion unit lower surface 81LS and a cushion bridge element 84. The bridge element 84 can extend over the bridge 44 of the shell 40, between cushion pod portions 85 and 86. The cushion can include a cushion unit upper surface 81US. The thickness of the cushion 81 bridge element 84 to the upper surface 81US can be greater over the lower wall of the respective compression pods, that is, in the pod portions 85 and 86, than it is over the respective bridge 44, that is, in the bridge element 84.

As illustrated, the cushion unit lower surface 81LS can be disposed at a level or elevation that is below the cushion bridge element 84 and that is below the bottom 72B of the transverse groove 72. This optionally can be repeated for each of the compression pods. In some cases, the cushion lower surface 81LS be joined with the compression pod wall lower wall upper surface 61US via a cement, a mechanical and/or a chemical bond. This cushion unit lower surface 81LS also can be lower in elevation than the bridge 44 of the adjacent portion of the shell 40. As mentioned above, the rear cushion unit 82 can have a similar structure, profile and features as the front unit 81.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

an upper;

an outsole joined with the upper, the outsole comprising:

a longitudinal axis and a width, with the width spanning from a lateral side to a medial side disposed across the longitudinal axis from the lateral side;

a resilient, flexible shell bounded by a sidewall that transitions to a support perimeter having a lower support perimeter surface;

a plurality of compression pods extending across a majority of the width and across the longitudinal axis, the plurality of compression pods each including a compression pod lower wall bottom surface, the plurality of compression pods surrounded by a common peripheral groove having a peripheral groove depth, the plurality of compression pods disposed on an interior of the common peripheral groove and disposed across from the support perimeter, the peripheral groove depth measured from the lower support perimeter surface upward, to a bottom of the common peripheral groove, the plurality of compression pods each having a height extending downward below the lower support perimeter surface, the height being substantially equal to the peripheral groove depth adjacent a respective compression pod, the plurality of compression pods separated from one another by a plurality of transverse grooves extending across the majority of the width and across the longitudinal axis, the plurality of transverse grooves each having a transverse groove depth greater than the peripheral groove depth adjacent the respective compression pod, the transverse groove depth being substantially equal to the peripheral groove depth plus the height, wherein each of the plurality of compression pods is configured to compress upward on at least one of the lateral side and the medial side, so that the compression pod lower wall bottom surface moves upward within the outsole toward a level of the lower support perimeter surface upon application of at least one of a lateral compression force and a medial compression force, respectively.

2. The article of footwear of claim 1, wherein the flexible shell adjacent the compression pod lower wall bottom surface has a thickness that is less than the transverse groove depth, wherein the flexible shell includes a bridge above the transverse groove that extends above a compression pod lower wall upper surface.

3. The article of footwear of claim 2, wherein the thickness extends between the compression pod lower wall bottom surface and the compression pod lower wall upper surface, wherein the compression pod lower wall upper surface is below the bridge.

4. The article of footwear of claim 3, wherein the compression pod lower wall upper surface is below a bottom of the transverse groove for each of the plurality of compression pods.

5. The article of footwear of claim 4, comprising:

a cushion unit disposed above the plurality of compression pods, wherein the cushion unit includes a cushion unit lower surface and a cushion bridge element, wherein the bridge element extends over the bridge, wherein the cushion unit lower surface is disposed at a level below the cushion bridge element, wherein the cushion unit is disposed within the flexible shell.

6. The article footwear of claim 5, wherein the cushion unit lower surface is joined with the compression pod lower wall upper surface, wherein the cushion unit lower surface is disposed below a bottom of the transverse groove for each of the plurality of compression pods.

7. The article of footwear of claim 1, wherein the plurality of compression pods include a front pod and a rear pod, wherein the flexible shell is a first thickness at a bottom of the rear pod and a second thickness at a bottom of the front pod, wherein the first thickness is 4.5 mm to 6.5 mm, inclusive, wherein the second thickness is 1.5 mm to 3.0 mm, inclusive, whereby the first thickness provides more shock absorption than the second thickness.

8. The article of footwear of claim 7, comprising:

a cushion unit disposed above the plurality of compression pods, wherein the cushion unit includes a cushion unit thickness that becomes progressively less as the cushion unit extends forwardly along the longitudinal axis from the rear pod to the front pod.

9. The article of footwear of claim 8, wherein the flexible shell forms a sidewall of the common peripheral groove adjacent at least one of the plurality of compression pods, wherein the sidewall is outwardly angled as the sidewall extends upward, wherein the sidewall is less than 2.5 mm in thickness, wherein the sidewall is configured to bend so that the at least one of the plurality of compression pods can compress upwardly into the outsole until the lower support perimeter surface of the perimeter support engages a ground surface.

10. The article of footwear of claim 9, wherein the plurality of transverse grooves intersects the common peripheral groove on the lateral side so that the transverse groove depth extends continuously beyond the lower support perimeter surface to a compression pod lower wall bottom surface.

11. An article of footwear comprising:

an upper;

an outsole joined with the upper, the outsole comprising:

a longitudinal axis and a width, with the width spanning from a lateral side to a medial side disposed across the longitudinal axis from the lateral side;

a resilient, flexible shell bounded by a sidewall that transitions to a support perimeter having a lower support perimeter surface, a first compression pod spanning a majority of the width from the medial side to the lateral side, the first compression pod having a first compression pod lower wall that has a first thickness, the first thickness extending between a first compression pod lower wall bottom surface and a first compression pod lower wall upper surface, the first compression pod lower wall bottom surface disposed below the lower support perimeter surface at a first height, the first compression pod including a first front edge that spans the majority of the width and a first rear edge that spans the majority of the width, the first rear edge bounded by a first transverse groove, the first front edge bounded by a second transverse groove, the first transverse groove having a first depth that is greater than the first thickness, the second transverse groove having a second depth that is greater than the first thickness, the first compression pod including a first medial edge bounded by a first medial groove, and a first lateral edge bounded by a first lateral groove, the lower support perimeter surface disposed opposite the first medial edge across the first medial groove, the lower support perimeter surface disposed opposite the first lateral edge across the first lateral groove, the first lateral groove having a third depth, the first lateral edge disposed below the lower support perimeter surface a third distance, the third distance being approximately equal to the third depth, the first medial groove having a fourth depth, the first medial edge disposed below the lower support perimeter surface a fourth distance, the fourth distance being approximately equal to the fourth depth so that the first compression pod lower wall bottom surface lays below the lower support perimeter surface the third distance on the lateral side and the fourth distance on the medial side, the first transverse groove being deeper than the first lateral groove and the first medial groove;

a second compression pod disposed forward of the first compression pod, the second compression pod spanning a majority of the width from the medial side to the lateral side, the second compression pod having a second compression pod lower wall that has a second thickness, the second thickness extending between a second compression pod lower wall bottom surface and a second compression pod lower wall upper surface, the second compression pod lower wall bottom surface extending below the lower support perimeter surface a fifth distance, the second compression pod including a second front edge that spans the majority of the width and a second rear edge that spans the majority of the width, the second rear edge bounded by the second transverse groove, the second front edge bounded by a third transverse groove, the third transverse groove having a fifth depth that is greater than the second thickness, the second transverse groove having the second depth that is greater than the second thickness, the second compression pod including a second medial edge bounded by a second medial groove and a second lateral edge bounded by a second lateral groove, the lower support perimeter surface disposed opposite the second medial edge across the second medial groove, the lower support perimeter surface disposed opposite the second lateral edge across the second lateral groove, the second lateral groove having a fifth depth, the second lateral edge extending below the lower support perimeter surface a sixth distance, the sixth distance being approximately equal to the fifth depth, the second medial groove having a sixth depth, the second medial edge extending below the lower support perimeter surface a seventh distance, the seventh distance being approximately equal to the sixth depth so that the second compression pod lower wall bottom surface lays below the lower support perimeter surface the sixth distance on the lateral side and the seventh distance on the medial side, the second transverse groove being deeper than the second lateral groove and the second medial groove.

12. The article of footwear of claim 11, comprising:

a cushion unit disposed above the plurality of compression pods, the cushion unit including a cushion unit thickness that becomes progressively less as the cushion unit extends forwardly along the longitudinal axis; and a Strobel board joined with the upper to close a bottom of the upper, the Strobel board being disposed above the cushion unit and the outsole.

13. The article of footwear of claim 12, wherein the shell is between 1.5 mm and 6.5 mm thick throughout the shell.

14. The article of footwear of claim 13, wherein the first compression pod lower wall first thickness is 2.0 mm to 3.5 mm, inclusive, wherein the second compression pod lower wall second thickness is 2.0 mm to 3.5 mm, inclusive, wherein the first lateral groove third depth is greater than the second lateral groove fifth depth.

15. The article of footwear of claim 11, wherein the sidewall includes an interior sidewall of the first lateral groove, wherein the interior sidewall is outwardly angled as the interior sidewall extends upward, wherein the interior sidewall is less than 2.5 mm in thickness, wherein the interior sidewall is configured to bend so that the first compression pod can compress upwardly into the outsole until the lower support perimeter surface of the perimeter support engages a ground surface, along with the first compression pod lower wall bottom surface.

16. The article of footwear of claim 15, wherein the first compression pod and the second compression pod are separated from one another by the second transverse groove, and from the lower perimeter support by the respective first and second lateral and medial grooves, wherein the first compression pod and the second compression pod are configured to flex upward on at least one of the lateral side and the medial side, independent of one another, due to the separation via the second transverse groove.

17. The article of footwear of claim 16, comprising:

a cushion unit disposed above the first and second compression pods, the cushion unit including a cushion unit lower surface that is disposed below a bottom of the second transverse groove.

18. An article of footwear comprising:

an upper;

an outsole joined with the upper, the outsole comprising:

a longitudinal axis and a width, with the width spanning from a lateral side to a medial side disposed across the longitudinal axis from the lateral side;

a resilient, flexible shell approximately 2.0 mm to 6.5 mm in thickness, the shell including a support perimeter having a lower support perimeter surface, a first compression pod spanning a majority of the width from the medial side to the lateral side, the first compression pod having a first compression pod lower wall bottom surface, a second compression pod spanning a majority of the width from the medial side to the lateral side, the second compression pod having a second compression pod lower wall bottom surface, a third compression pod spanning a majority of the width from the medial side to the lateral side, the third compression pod having a third compression pod lower wall bottom surface, wherein the first and second compression pods are separated by a second transverse groove, wherein the second and third compression pods are separated by a third transverse groove, wherein the first compression pod and the second compression pod are configured to flex upward on the lateral side in a tilting manner and upward on the medial side in a tilting manner, independent of one another, due to the separation via the second transverse groove, wherein the second compression pod and the third compression pod are configured to flex upward on the lateral side in a tilting manner and upward on the medial side in a tilting manner, independent of one another, due to the separation via the third transverse groove, wherein the first, second and third compression pods are at least partially surrounded by a common peripheral groove that is shallower than each of the second and third transverse grooves.

19. The article of footwear of claim 18, comprising:

a cushion unit disposed above the first second and third compression pods, the cushion unit including a cushion unit thickness that becomes progressively greater as the cushion unit extends forwardly along the longitudinal axis; and a Strobel board joined with the upper to close a bottom of the upper, the Strobel board being disposed above the cushion unit and the outsole.

20. The article of footwear of claim 19, wherein the cushion unit includes a cushion unit lower surface that is disposed below a bottom of the second transverse groove and below a bottom of the third transverse groove.

* * * * *